US006188851B1

(12) United States Patent
Eom

(10) Patent No.: US 6,188,851 B1
(45) Date of Patent: Feb. 13, 2001

(54) LIQUID ELECTROPHOTOGRAPHIC IMAGING APPARATUS UPGRADE SUPPORT SYSTEM USING NETWORK AND METHOD FOR UPGRADING DATA FOR CALCULATING CONCENTRATION OF DEVELOPER

(75) Inventor: Yoon-seop Eom, Suwon (KR)

(73) Assignee: Samsung Electronics Co., Ltd., Kyungki-Do (KR)

( * ) Notice: Under 35 U.S.C. 154(b), the term of this patent shall be extended for 0 days.

(21) Appl. No.: 09/414,425

(22) Filed: Oct. 7, 1999

(30) Foreign Application Priority Data

Dec. 11, 1998 (KR) ..... 98-54535

(51) Int. Cl.[7] ..... G03G 15/00

(52) U.S. Cl. ..... 399/8; 395/1.15; 399/57; 399/58

(58) Field of Search ..... 399/8, 9, 27, 30, 399/57, 58, 61, 62; 430/117; 358/1.15, 1.16

(56) References Cited

U.S. PATENT DOCUMENTS 5,887,216 * 3/1999 Motoyama ..... 399/8
5,933,676 * 8/1999 Ohno ..... 399/8

FOREIGN PATENT DOCUMENTS 4-153680 5/1992 (JP) .
2666930 6/1997 (JP) .
9-163065 6/1997 (JP) .

* cited by examiner

*Primary Examiner*—Sophia S. Chen
(74) *Attorney, Agent, or Firm*—Sughrue, Mion, Zinn Macpeak & Seas, PLLC

(57) ABSTRACT

A liquid electrophotographic imaging apparatus support system using a network contains an upgrade support server including a database for storing information on developer products in order to provide a service supporting upgrade of data to calculate densities with respect to developer products, and an upgrade support engine connected to a network for supporting access to and search of the database; and a liquid electrophotographic imaging apparatus including a communication device for connecting to the upgrade support server through the network, searching the information on the developer products stored in the database by exchanging information with the upgrade support engine, and downloading the density calculating data with respect to a desired developer product. According to the liquid electrophotographic imaging apparatus upgrade support system using the network and the method for upgrading the data for calculating the density of the developer, it is possible to upgrade the developer density calculating data more easily since the density calculating data corresponding to the developer product to be used can be installed in the liquid electrophotographic printer through a network without replacing hardware.

17 Claims, 5 Drawing Sheets

LIQUID ELECTROPHOTOGRAPHIC IMAGING APPARATUS UPGRADE SUPPORT SYSTEM USING NETWORK AND METHOD FOR UPGRADING DATA FOR CALCULATING CONCENTRATION OF DEVELOPER

BACKGROUND OF THE INVENTION

1. Field of the Invention

The present invention relates to a liquid electrophotographic imaging apparatus upgrade support system using network and method for upgrading data for calculating the concentration of a developer. The present application is based upon Korean Application No. 98-54535, which is incorporated herein by reference.

2. Description of the Related Art

FIG. 1 shows a general liquid electrophotographic color printer. Referring to FIG. 1, a printer includes a reset device 15 adjacent to a circulation path of a photosensitive belt 14 that circulates around rollers 11, 12, and 13, optical scanning units 16, developing devices 30, a drying device 18, and a transfer device 20. Reference numeral 39 is a waste developer container.

The reset device 15 includes an erasing device 15*a* for irradiating light to the photosensitive belt 14 to remove an electrostatic latent image, and a charging device 15*b* for charging the photosensitive belt 14 to a predetermined electric potential.

Four optical scanning units 16 respectively scan yellow Y, magenta M, cyan C, and black K color information. The four developing devices 30 respectively supply yellow Y, magenta M, cyan C, and black K developers to the photosensitive belt 14.

The developing devices 30 include a developer supply container 32 for holding developer 33 to be supplied to the photosensitive belt 14, and a developer tub 31 for collecting developer 33 that falls from the photosensitive belt 14. A developing roller 36, a brush roller 37 for removing developer 33 stuck on the developing roller 36, a squeeze roller 34 for separating a liquid carrier from the developer 33 supplied to the photosensitive belt 14, and a plate 35 for collecting the liquid carrier that falls down through the squeeze roller 34 in the developer tub 31 are arranged in the developing tub 31.

The developer supply container 32 is designed to receive the developer 33 stored in the developer tub 31 and the liquid carrier (norpor) N, which is a solvent and toner or highly concentrated developer that is a developing material from a developer supplier 38. The developer 33 stored in the developer supply container 32 is supplied between the developing roller 36 and the photosensitive belt 14 by the driving of a pump (P).

In the operation of such a liquid electrophotographic printer, the optical scanning unit 16 scans light onto the circulating photosensitive belt 14, passing by the reset device 15. A latent image is formed on the photosensitive belt 14 by the scanned light. The latent image is developed by the developer 33 supplied from the developer supply container 32 of the developing device 30. A color image is formed on the photosensitive belt 14 by the optical scanning units 16 and the developing devices 30. The optical scanning units 16 scan light having different color information and the developing devices 30 develop color information by the developer 33 having colors corresponding to the color information. Most of the liquid carrier in the developer 33 supplied from the developing device 30 to the photosensitive belt 14 during a developing process is collected in the developer tub 31. The color image formed on the photosensitive belt 14 is first transferred to a transfer roller 21, and passed through the drying device 18 for absorbing, evaporating, and removing the liquid carrier remaining on the photosensitive belt 14 by a continuous movement of the photosensitive belt 14. The image on the transfer roller 21 is then transferred to paper 23 by rotating the transfer roller 21 against a backup roller 22, with the received paper 23 therebetween.

In order to maintain the quality of a picture in the above-mentioned liquid electrophotographic printer, the density of the developer 33 supplied to the photosensitive belt 14, i.e., ratio of toner to liquid carrier, should be appropriately maintained. In order to do this, it is necessary to measure the density of the developer 33 to be supplied to the photosensitive belt 14.

A developer density measuring device, as shown in FIG. 2, includes a density information generator 40, an engine controller 50, and a LUT (look-up table) 51. The density information generator 40 includes a light source 41 for irradiating light to the developer 33 to be examined, and a photodetector 42 located on the opposite side of the light source 41 for receiving light passing through the developer 33 and outputting a signal corresponding to the amount of light received. The density of the developer 33 or a density calculating equation for calculating the density of the developer corresponding to the signal output from the photodetector 42 is recorded in a LUT 51. Therefore, the engine controller 50 for controlling the respective devices of FIG. 1 reads digital information input corresponding to the amount of light received from the photodetector 42 through an analog-to-digital (A/D) converter 43, searches the density of the developer 33 corresponding to the read digital value in the LUT 51, and determines the density of the developer 33. When the density of the calculated developer 33 is outside of a set range, the engine controller 50 controls a concerned pump P and a valve V so that the highly concentrated developer and the liquid carrier are appropriately supplied from the developer supplier 38 to the developer supplying container 32.

Since the developer 33 is consumed during printing, new developer must be supplied after the developer is consumed. Components that form the developer 33 may change due to continuous development of technology for improving the performance of products and printing ability. Therefore, the developer 33 whose components may change may have different optical transmission characteristics. As a result, in order to use a developer 33 whose components may change, a density measuring device suitable for the changing developer is required.

A method of replacing the circuit substrate of the density measuring device whenever the components of the developer 33 to be used are changed requires a complicated circuit substrate replacement task. Thus, it is not economically feasible.

SUMMARY OF THE INVENTION

To solve the above problem, it is an object of the present invention to provide a liquid type image printing apparatus upgrade support system using a network that can facilitate the upgrade of a density measuring device for calculating the density of a developer to be used, and a method for upgrading data for calculating the density of the developer.

Accordingly, to achieve the above object, there is provided a liquid electrophotographic imaging apparatus support system using a network, comprising an upgrade support server including a database for storing information on developer products in order to provide a service supporting upgrade of data for calculating densities with respect to developer products, and an upgrade support engine connected to a network for supporting access to and search of the database; and a liquid electrophotographic imaging apparatus including communication means for connecting to the upgrade support server through the network, searching the information on the developer products stored in the database by exchanging information with the upgrade support engine, and downloading the density calculating data with respect to a desired developer product.

The liquid electrophotographic imaging apparatus preferably comprises a computer connected to the network and a liquid electrophotographic printer connected to the computer.

To achieve the above object, there is provided a method for upgrading developer density calculating data of a liquid electrophotographic imaging apparatus upgrade support system using a network, comprising the steps of (a) determining whether density calculating data with respect to developer to be used is in the liquid electrophotographic imaging apparatus, and (b) downloading the density calculating data with respect to the developer to be used from the database to the liquid electrophotographic imaging apparatus through the network when it is determined that there is no density calculating data with respect to the developer to be used in the step (a).

BRIEF DESCRIPTION OF THE DRAWING(S)

The above objective and advantages of the present invention will become more apparent by describing in detail a preferred embodiment thereof with reference to the attached drawings in which.

DESCRIPTION OF THE PREFERRED EMBODIMENT(S)

Figure 3:
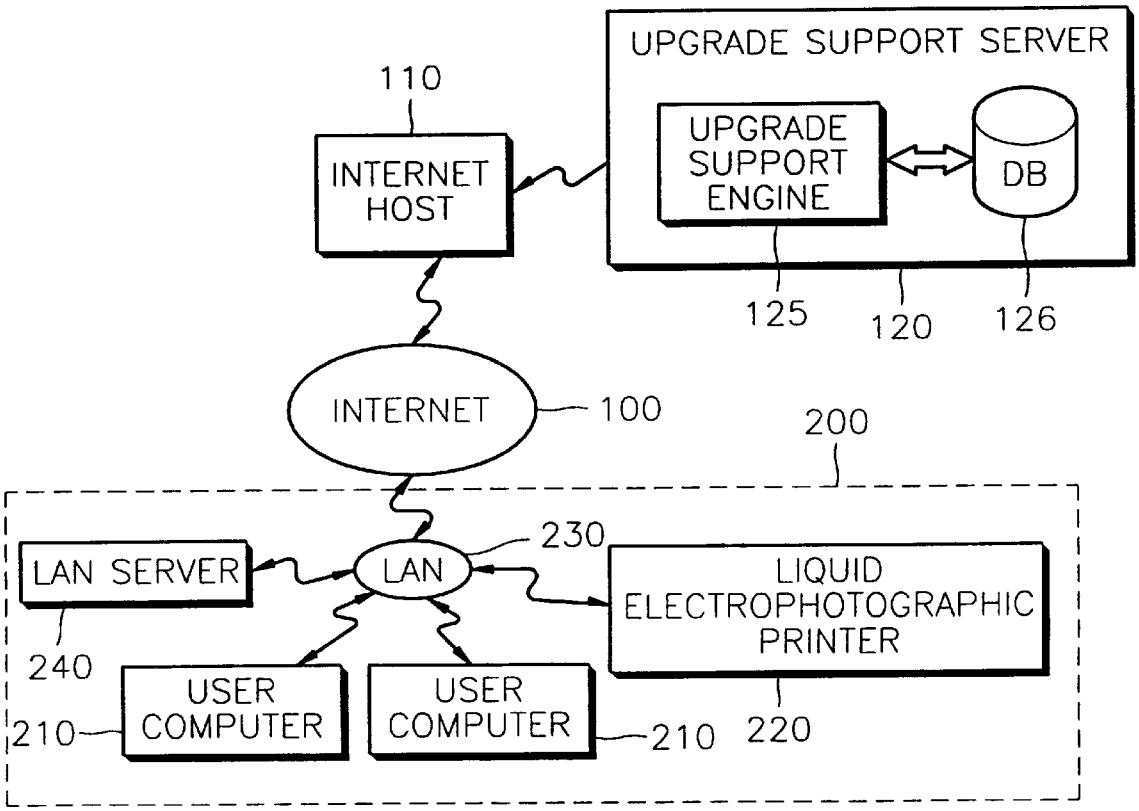
FIG. 3 is a block diagram showing a liquid electrophotographic imaging apparatus upgrade support system using a network according to the present invention.

Referring to FIG. 3, the liquid electrophotographic imaging apparatus upgrade support system includes an upgrade support server 120 connected to the Internet 100, which is a network through an Internet host 110, and a liquid electrophotographic imaging apparatus 200 designed to be connected to the upgrade support server 120 through the Internet 100. The liquid electrophotographic imaging apparatus 200 includes a plurality of user computers 210 and a liquid electrophotographic printer 220 that is connected to the user computers 210 by a local area network (LAN) 230. The user computers 210 exchange information with the liquid electrophotographic printer 220 by the LAN 230, which is a network controlled by a LAN server 240.

Figure 4:
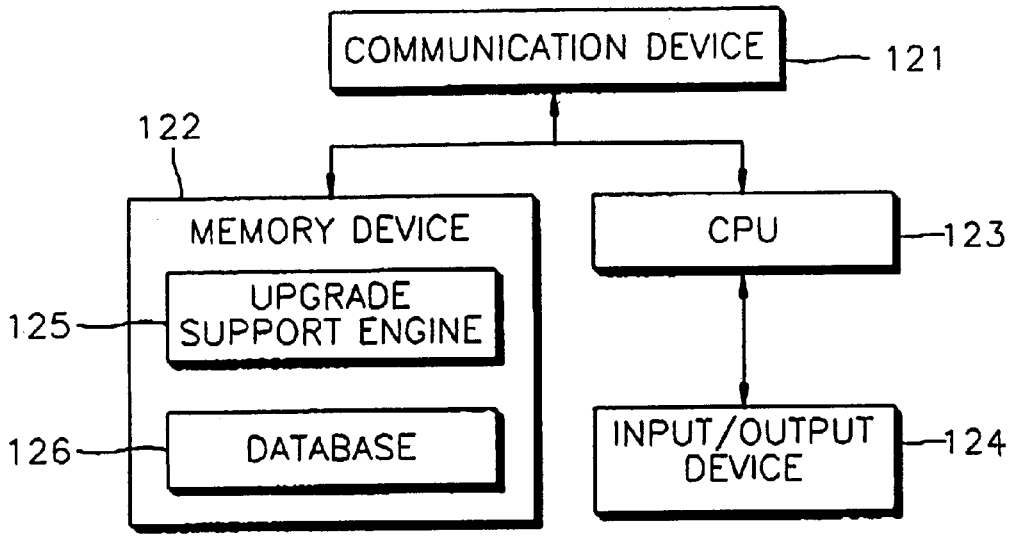
FIG. 4 is a block diagram showing an upgrade support server of FIG. 3.

The upgrade support server 120 includes a communication device 121, a memory device 122, a central processing unit CPU 123, and an input/output device 124, as shown in FIG. 4. A leased-line directly connected to the Internet host 110 or modem can be an example of the communication device 121 that communicates with the Internet 100. An upgrade support engine 125 and a database 126 are installed in the memory device 122.

The upgrade support engine 125 exchanges information with the user computers 210, which is an external device connected through the Internet 100. The upgrade support engine 125 is a software program for accessing the database 126 to search for information requested by the user computers 210 or supporting the user computers 210 to directly access the database 126 and search for relevant information.

Related information including data for calculating the density of the developer is systematically recorded in the database 126 with respect to a plurality of developer models supplied by a manufacturing company. The database 126 is updated by the manufacturing company at any time.

Figure 5:
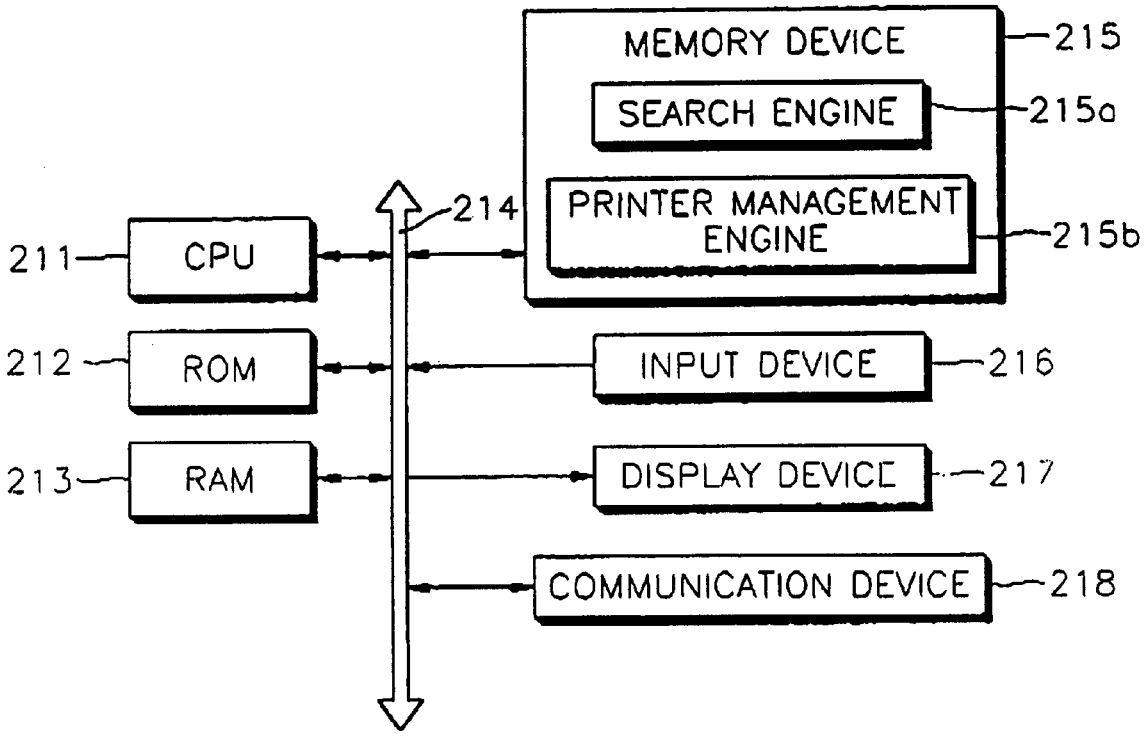
FIG. 5 is a block diagram showing a user computer of FIG. 3.

The computer 210 includes a CPU 211, a ROM 212, a RAM 213, a memory device 215, an input device 216, a display device 217, and a communication device 218, which are connected to each other by a bus 214, as shown in FIG. 5. The communication device 218 includes the leased-line directly connected to the Internet host 110 or modem in order to communicate with the Internet 100, and a LAN card for communicating with a liquid electrophotographic printer 220.

A search engine 215*a* installed in the memory device 215 accesses the database 126 of the upgrade support server 120, and searches the data for calculating the density of the developer product to be used. A printer management engine 215*b* is preferably installed in the memory device 215. The printer management engine 215*b* is a software program for upgrading a liquid electrophotographic printer 220 by exchanging information with the liquid electrophotographic printer 220. The printer management engine 215*b* manages the data for calculating densities with respect to developer models recorded in the liquid electrophotographic printer 220, and processes information of requesting to update the data for calculating a density with respect to a new developer model, which is received from the liquid electrophotographic printer 220. Namely, the printer management engine 215*b* provides requested items received from the liquid electrophotographic printer 220 to a user through the display device 217 or instructs the search engine 215*a* to download the data for calculating the densities with respect to the developer models corresponding to the requested items, and transfers the downloaded density calculating data to the liquid electrophotographic printer 220.

Figure 6:
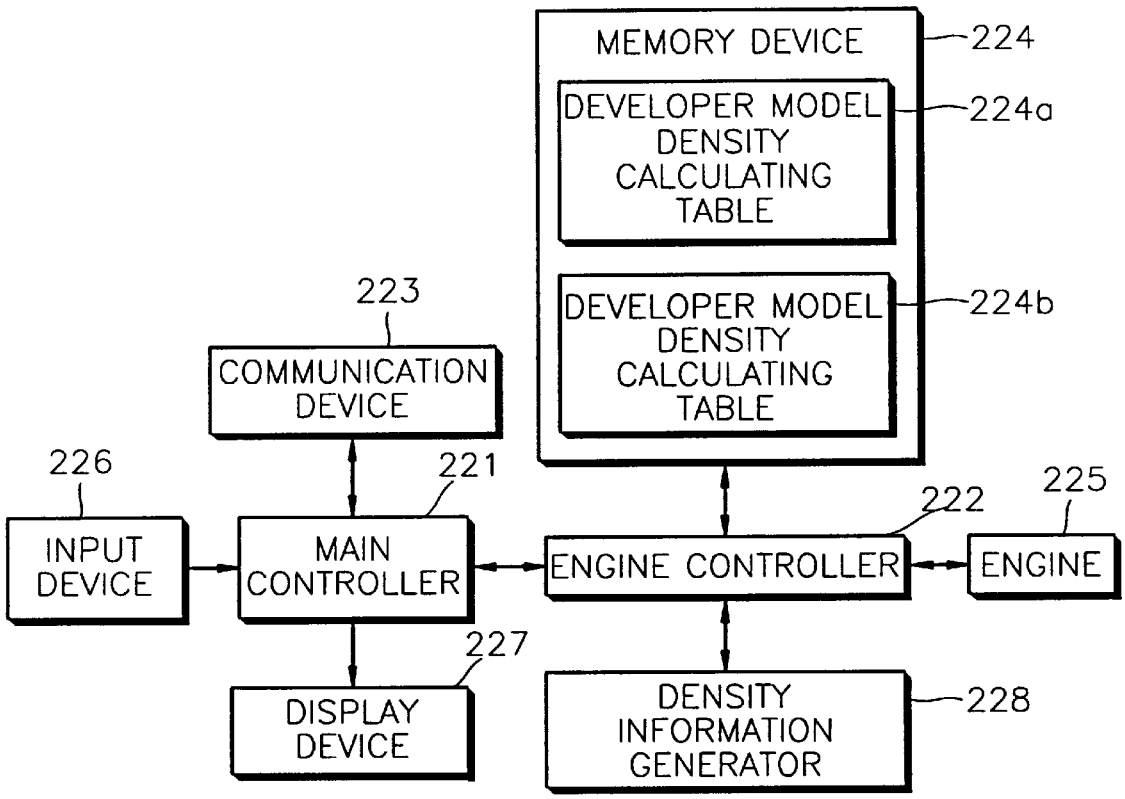
FIG. 6 is a block diagram showing a liquid electrophotographic printer of FIG. 3.

The liquid electrophotographic printer 220 includes a main controller 221, an engine controller 222, a communication device 223, a memory device 224, an engine 225, an input device 226, a display device 227, and a density information generator 228, as shown in FIG. 6.

Figure 1:
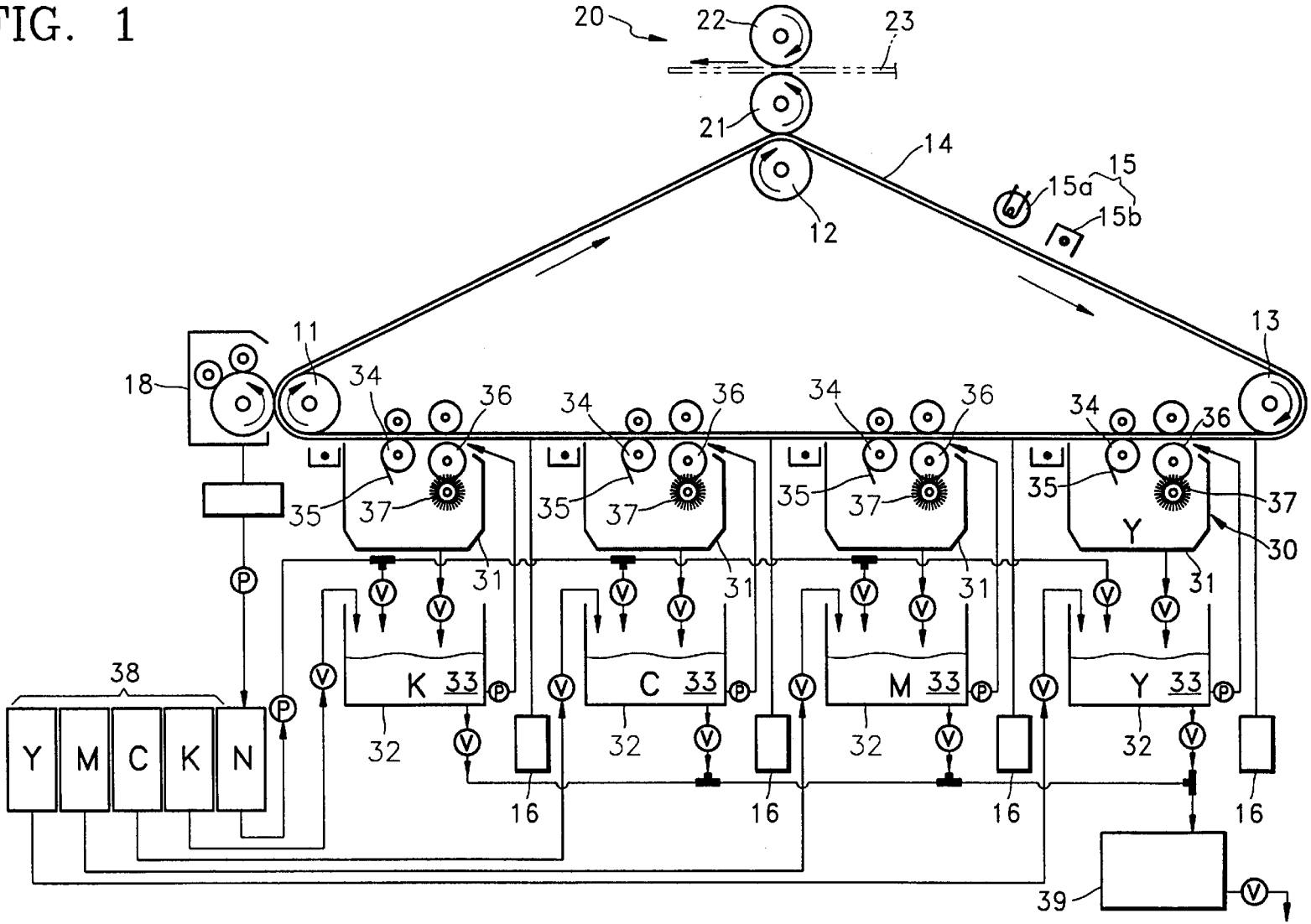
FIG. 1 is a sectional view showing a general liquid electrophotographic printer.
Figure 2:
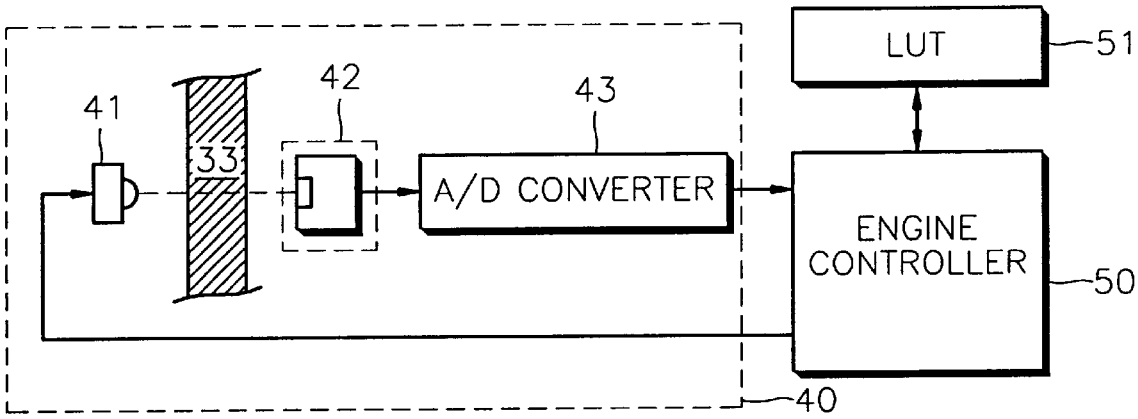
FIG. 2 shows an example of a developer density calculating device used for the liquid electrophotographic printer of FIG. 1.

The density information generator 228 is constructed by various methods to generate a signal corresponding to the density of the developer to be examined. As an example, the density information generator 228 is constructed to irradiate light to the developer to be examined, to receive the light passing through the developer, and to output a signal corresponding to the light received to the engine controller 222 (40 in FIG. 2). The density information generator 228 may be constructed to generate information on the density of the developer by detecting the amount of light reflected from the developer to be examined. The density information generator 228 may be constructed to generate the information on the density of the developer by detecting a change in capacitance of the developer to be examined. A LAN card for communicating with the user computers 210 is used as the communication device 223.

The main controller 221 for controlling the liquid electrophotographic printer 220 reads and processes information received from the computer 210. When the data for calculating the density of the developer is received from the computer 210, the main controller 221 stores the data in the memory device 224 used by the engine controller 222. A signal indicating that there is no data for calculating the density of the developer with respect to the loaded product is received from the engine controller 222. The main controller 221 transfers a message requesting an update of data for calculating the density of the developer to the display device 227 and/or the user computers 210.

The engine controller 222 controls the density information generator 228, and measures the density of the developer using the data corresponding to the loaded product among the data for calculating the densities recorded in the memory device 224 with respect to developer models. The data for calculating the densities is recorded in the memory device 224 in the form of a developer model density calculating table 224*a* and/or a developer model density calculating equation 224*b*. The density of the developer corresponding to signals output from the density information generator 228 are recorded in the developer model density calculating table 224*a* by a one-to-one correspondence method. The developer model density calculating equation 224*b* corresponds to an equation for calculating the density of the developer by substituting the signal output from the density information generator 228.

The engine controller 222 stores the data for calculating the density of the developer received from the main controller 221 in the memory device 224 together with the model of the product. The developer model of the density calculating data to be used by the engine controller 222 when the density of the developer is calculated is set using the input device 226. Preferably, the product is provided so that the engine controller 222 can read the model thereof and the engine controller 222 automatically sets the model read from the loaded product to be applied for calculating density. The engine 225 prints an image corresponding to image data on paper.

Figure 7:
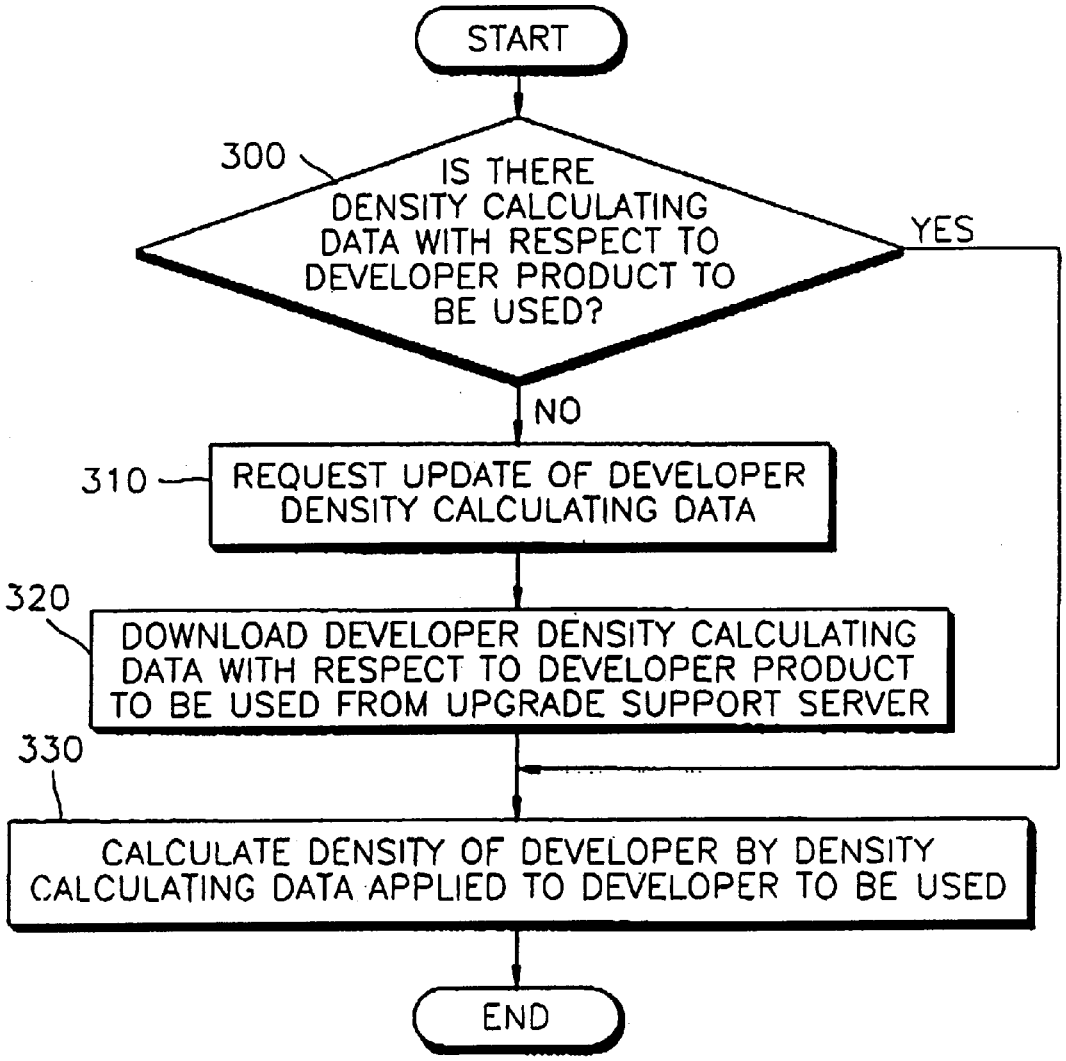
FIG. 7 is a flow diagram showing processes of upgrading data for calculating the density of a developer of the liquid electrophotographic imaging apparatus upgrade support system using the network according to the present invention.

Referring to FIG. 7, in a case where a model name is recorded on the developer product loaded in the liquid electrophotographic printer 220 so as to be read by the engine controller 222, it is determined whether the data for calculating the density with respect to the developer product to be used is recorded in the memory device 224 of the liquid electrophotographic printer 220 (step 300). Namely, the engine controller 222 determines whether the density calculating data corresponding to the model name read from the loaded product is in the memory device 224 and sends the determination result to the main controller 221. In this case, when a signal indicating that there is no data for calculating the density with respect to the loaded product is received from the engine controller 222, the main controller 221 displays the model name of the loaded product together with a message requesting an update of the developer density calculating data to the display device 227 and/or the user computers 210 (step 310).

When it is determined that the density calculating data with respect to the developer product to be used in the step 300 is determined not to exist in the memory device 224 of the liquid electrophotographic printer 220, relevant density calculating data is downloaded from the upgrade support server 120 and is transferred to the liquid electrophotographic printer 220 (step 320). The main controller 221 of the liquid electrophotographic printer 220 stores the requested developer density calculating data in the memory device 224 through the engine controller 222.

When developer density calculating data suitable for the developer product to be used is loaded into the memory device 224, the engine controller 222 can calculate the density of the developer corresponding to the light receiving information output from the density information generator 228 using the developer density calculating data corresponding to the loaded developer product (step 330).

In the case that the step 300 is directly performed by the user, namely, the user determines whether the density calculating data with respect to the product to be used is loaded in the memory device 224 by executing the printer management engine 215*b* of the computer 210 and receiving a model list of the density calculating data in the memory device 224 of the liquid electrophotographic printer 220 through the display device 217, the engine controller 222 can calculate the density of the developer corresponding to the light receiving information output from the density information generator 228 using the developer density calculating data corresponding to the loaded developer product (step 330).

As mentioned above, according to the liquid electrophotographic imaging apparatus upgrade support system using the network and the method for upgrading the data for calculating the density of the developer, it is possible to upgrade the developer density calculating data more easily since the density calculating data corresponding to the developer product to be used can be loaded into the liquid electrophotographic printer through a network without replacing hardware.

Having described the invention in detail and by reference to the drawings, it will be apparent that modification and variations are possible without departing from the scope of the invention. Therefore, it is intended that the invention not be limited by the precise structure shown and described, but rather the full scope of the invention as defined in the following claims.

What is claimed is:

1. A liquid electrophotographic imaging apparatus upgrade support system using a network comprising:

an upgrade support server including a database for storing information on developer products in order to provide a service supporting upgrade of data to calculate densities with respect to developer products, and an upgrade support engine connected to a network for supporting access to and search of said database; and a liquid electrophotographic imaging apparatus including communication means for connecting to said upgrade support server through said network, searching said information on said developer products stored in said database by exchanging information with said upgrade support engine, and downloading density calculating data with respect to a desired developer product.

2. The liquid electrophotographic imaging apparatus upgrade support system of claim 1, wherein said liquid electrophotographic imaging apparatus further comprises:

a computer connected to said network; and a liquid electrophotographic printer connected to said computer.

3. The liquid electrophotographic imaging apparatus upgrade support system of claim 2, wherein said liquid electrophotographic imaging apparatus further comprises a plurality of user computers connected to said computer.

4. The liquid electrophotographic imaging apparatus upgrade support system of claim 3, wherein said upgrade support engine accesses said database to search for information requested by said user computers.

5. The liquid electrophotographic imaging apparatus upgrade support system of claim 3, wherein said upgrade support engine supports said user computers to directly access said database and search for relevant information.

6. The liquid electrophotographic imaging apparatus upgrade support system of claim 1, wherein said network is an Internet.

7. The liquid electrophotographic imaging apparatus upgrade support system of claim 1, wherein said database contains a plurality of developer models.

8. The liquid electrophotographic imaging apparatus upgrade support system of claim 7, wherein said database is updated externally.

9. A method for upgrading developer density calculating data of a liquid electrophotographic imaging apparatus upgrade support system using a network containing an upgrade support server including a database for storing information on developer products in order to provide a service of supporting an upgrade of data to calculate densities with respect to developer products and an upgrade support engine connected to said network for supporting access to and search of said database, and a liquid electrophotographic imaging apparatus including communication means for connecting to said upgrade support server through said network, searching said information on said developer products stored in said database by exchanging information with said upgrade support engine, and downloading said density calculating data with respect to a desired developer comprising the steps of:

(a) determining whether said density calculating data with respect to said developer to be used is in said liquid electrophotographic imaging apparatus; and (b) downloading said density calculating data with respect to said developer to be used from said database to said liquid electrophotographic imaging apparatus through said network when it is determined that there is no density calculating data with respect to said developer to be used in step (a).

10. The method of claim 9, wherein said liquid electrophotographic imaging apparatus comprises:

a computer connected to said network; and a liquid electrophotographic printer connected to said computer.

11. The method of claim 10, wherein said liquid electrophotographic imaging apparatus further comprises a plurality of user computers for exchanging information with said liquid electrophotographic printer by said computer.

12. The method of claim 11, wherein said upgrade support engine accesses said database to search for information requested by said user computers.

13. The method of claim 11, wherein said upgrade support engine supports said user computers to directly access said database and search for relevant information.

14. The method of claim 9, further comprising a step of displaying a message requesting a user to upgrade developer density calculating data on a display device of said liquid electrophotographic imaging apparatus when it is determined that there is no density calculating data with respect to said developer to be used in step (a).

15. The method of claim 9, wherein said network is an Internet.

16. The method of claim 9, wherein said database contains a plurality of developer models.

17. The method of claim 16, wherein said database is updated externally.

* * * * *